US008870006B2

(12) United States Patent
Kamineni et al.

(10) Patent No.: US 8,870,006 B2
(45) Date of Patent: Oct. 28, 2014

(54) HOT-FILL CONTAINER PROVIDING VERTICAL, VACUUM COMPENSATION

(75) Inventors: Satya Kamineni, Lockport, IL (US); Michael R. Mooney, Frankfort, IL (US); Timothy Boyd, Frankfort, IL (US)

(73) Assignee: Plastipak Packaging, Inc., Plymouth, MI (US)

( * ) Notice: Subject to any disclaimer, the term of this patent is extended or adjusted under 35 U.S.C. 154(b) by 501 days.

(21) Appl. No.: 12/990,055

(22) PCT Filed: Apr. 30, 2009

(86) PCT No.: PCT/US2009/042378

§ 371 (c)(1), (2), (4) Date: Nov. 29, 2011

(87) PCT Pub. No.: WO2009/135046

PCT Pub. Date: Nov. 5, 2009

(65) Prior Publication Data

US 2012/0061410 A1 Mar. 15, 2012

Related U.S. Application Data

(60) Provisional application No. 61/049,147, filed on Apr. 30, 2008.

(51) Int. Cl.

| | |
|---|---|
| ***B65D 1/02*** | (2006.01) |
| ***B65B 3/04*** | (2006.01) |
| ***B65D 1/44*** | (2006.01) |

(52) U.S. Cl.

CPC ..... *B65D 1/0223* (2013.01); *B65B 3/04* (2013.01); *B65D 1/0261* (2013.01); *B65D 1/44* (2013.01); *B65D 2501/0036* (2013.01)

USPC ..... 215/382; 215/381; 220/669; 53/473

(58) Field of Classification Search

CPC ..... B65D 1/0292; B65D 1/0223; B65D 1/44; B65D 11/24; B65D 11/22; B65D 90/027; B65D 2501/0036; B65D 2501/0018

USPC ..... 215/382, 381, 379; 220/675, 669, 660; 264/454, 478; 53/473, 471, 469, 467

IPC ..... B65D 90/02; B65B 3/04, 1/04

See application file for complete search history.

(56) References Cited

U.S. PATENT DOCUMENTS 4,610,366 A 9/1986 Estes et al.
4,790,361 A * 12/1988 Jones et al. ..... 220/666

(Continued)

FOREIGN PATENT DOCUMENTS

WO WO 2007006880 A1 * 1/2007 ..... B65D 79/00

OTHER PUBLICATIONS

Translation of WO 2007/006880 (Boukobza) Jan. 18, 2007, Paragraphs 8 and 15.*

*Primary Examiner* — Robert J Hicks

(74) *Attorney, Agent, or Firm* — Greer, Burns & Crain, Ltd.

(57) ABSTRACT

Provided is a hot-fill container adapted to provide vertical vacuum compensation in response to negative pressure inside the container. The container comprises one or more horizontal ribs that are configured to diminish in height in response to vacuum conditions inside the container. Each rib comprises an upper wall connected to a lower wall. The upper and lower walls are inclined from a horizontal reference line and adapted to hinge with respect to each other to provide vertical vacuum compensation.

19 Claims, 10 Drawing Sheets

(56) References Cited

U.S. PATENT DOCUMENTS

| | | | | | |
|---|---|---|---|---|---|
| 4,805,788 | A | * | 2/1989 | Akiho | 215/381 |
| 4,863,046 | A | | 9/1989 | Collette et al. | |
| 5,054,632 | A | | 10/1991 | Alberghini et al. | |
| 5,238,129 | A | | 8/1993 | Ota | |
| 5,303,834 | A | | 4/1994 | Krishnakumar et al. | |
| D347,391 | S | | 5/1994 | Guertin | |
| 5,337,909 | A | | 8/1994 | Vailliencourt | |
| 5,341,946 | A | * | 8/1994 | Vailliencourt et al. | 215/381 |
| 5,472,105 | A | * | 12/1995 | Krishnakumar et al. | 215/384 |
| 5,690,244 | A | | 11/1997 | Darr | |
| 5,704,503 | A | | 1/1998 | Krishnakumar et al. | |
| 5,908,128 | A | | 6/1999 | Krishnakumar et al. | |
| 6,036,037 | A | | 3/2000 | Scheffer et al. | |
| 6,065,624 | A | | 5/2000 | Steinke | |
| 6,223,920 | B1 | | 5/2001 | Lane et al. | |
| 6,296,131 | B2 | | 10/2001 | Rashid | |
| 6,974,047 | B2 | | 12/2005 | Kelley et al. | |
| 7,025,219 | B2 | | 4/2006 | Heisner et al. | |
| 7,159,729 | B2 | | 1/2007 | Sabold et al. | |
| 7,296,703 | B2 | * | 11/2007 | Lane | 215/384 |
| 2001/0006165 | A1 | * | 7/2001 | Rashid | 215/383 |
| 2005/0279728 | A1 | | 12/2005 | Finlay et al. | |
| 2006/0076310 | A1 | * | 4/2006 | Mooney et al. | 215/382 |
| 2006/0186082 | A1 | * | 8/2006 | Gatewood et al. | 215/381 |
| 2006/0186083 | A1 | | 8/2006 | Joshi et al. | |
| 2007/0012649 | A1 | | 1/2007 | Kamineni et al. | |
| 2007/0012650 | A1 | | 1/2007 | Eble | |
| 2007/0199916 | A1 | | 8/2007 | Denner et al. | |
| 2008/0190884 | A1 | | 8/2008 | Maczek et al. | |
| 2008/0197105 | A1 | | 8/2008 | Boukobza | |

* cited by examiner

HOT-FILL CONTAINER PROVIDING VERTICAL, VACUUM COMPENSATION

CROSS-REFERENCE TO RELATED APPLICATIONS

This application is the National Stage of International Application No. PCT/US2009/042378, filed Apr. 30, 2009, which claims the benefit of U.S. Provisional Application No. 61/049,147, filed Apr. 30, 2008, the disclosures of which are incorporated herein by reference in their entirety.

TECHNOLOGY FIELD

The present disclosure relates to containers, and more particularly to pressure-responsive plastic containers.

BACKGROUND

It has been a goal of conventional container design to form container bodies that have a desired and predictable shape after filling and at the point of sale. For example, it is often desired to produce containers that maintain an approximately cylindrical body or a circular transverse cross section. However, in some instances, the containers are susceptible to negative internal pressure (that is, relative to ambient pressure), which causes the containers to deform and lose rigidity and stability, and results in an overall unaesthetic appearance. Several factors can contribute to the buildup of negative pressure inside the container.

For instance, in a conventional hot-fill process, the liquid or flowable product is charged into a container at elevated temperatures, such as 180 to 190 degrees F., under approximately atmospheric pressure. Because a cap hermetically seals the product within the container while the product is at the hot-filling temperature, hot-fill plastic containers are subject to negative internal pressure upon cooling and contraction of the products and any entrapped air in the head-space. The phrase hot filling as used in the description encompasses filling a container with a product at an elevated temperature, capping or sealing the container, and allowing the package to cool.

As another example, plastic containers are also often made from materials such as polyethylene terephthalate (PET) that can be susceptible to the egress of moisture over time. Biopolymers or biodegradable polymers, such as polyhydroxyalkanoate (PHA) also exacerbate egress issues. Accordingly, moisture can permeate through container walls over the shelf life of the container, which can cause negative pressure to accumulate inside the container. Thus, both hot-fill and cold-fill containers are susceptible to the accumulation of negative pressure capable of deforming conventional cylindrical container bodies.

Many conventional cylindrical containers would deform or collapse under the internal vacuum conditions without some structure to prevent it. To prevent collapse, some containers have panels, referred to as "vacuum panels," located in the body sidewall. The vacuum panels are configured to flex radially inward in response to internal vacuum such that the remainder of the container body remains cylindrical. Although the deflection of the panels enables the remainder of the container to have its desired shape, the area that includes the vacuum panels still undergoes radial deformation, which is not aesthetically or commercially appealing and presents difficulties for labeling.

Thus, it is desirable to provide a hot-fill container capable of providing vacuum compensation structure that flexes in a non-radial direction in response to the accumulation of negative internal pressure.

SUMMARY

This Summary is provided to introduce a selection of concepts in a simplified form that are further described below in the Detailed Description of Illustrative Embodiments. This Summary is not intended to identify key features or essential features of the invention, nor is it intended to be used to limit the scope of the invention.

According to one embodiment, a pressure-responsive container includes a lower portion having an enclosed base, an upper portion having a dome and a finish, and a generally cylindrical body portion extending vertically between the lower portion and the upper portion. The body portion includes an upper sidewall and a lower sidewall, and further includes at least one circumferential rib disposed between the upper and lower sidewalls. The rib includes a substantially straight upper wall, a substantially straight lower wall, and a curved central portion connecting the upper wall and the lower wall. The upper wall extends downward and radially inward from the upper sidewall so as to define a first angle less than 35 degrees with respect to a horizontal reference line. The substantially straight lower wall extends upward and radially inward from the lower sidewall so as to define a second angle less than 35 degrees from the horizontal reference line. The straight upper wall and the straight lower wall are adapted to hinge with respect to each other in response to a vacuum created inside the container such that a height of the container is reduced while the body portion retains a substantially cylindrical shape.

Additional features and advantages will be made apparent from the following detailed description of illustrative embodiments that proceeds with reference to the accompanying drawings.

BRIEF DESCRIPTION OF THE DRAWINGS

The foregoing summary, as well as the following detailed description, is better understood when read in conjunction with the appended drawings. For the purpose of illustrating the container of the present invention, there is shown in the drawings exemplary embodiments; however, the container of the present is not limited to the specific embodiments disclosed.

DETAILED DESCRIPTION OF ILLUSTRATIVE EMBODIMENTS

Figure 1:
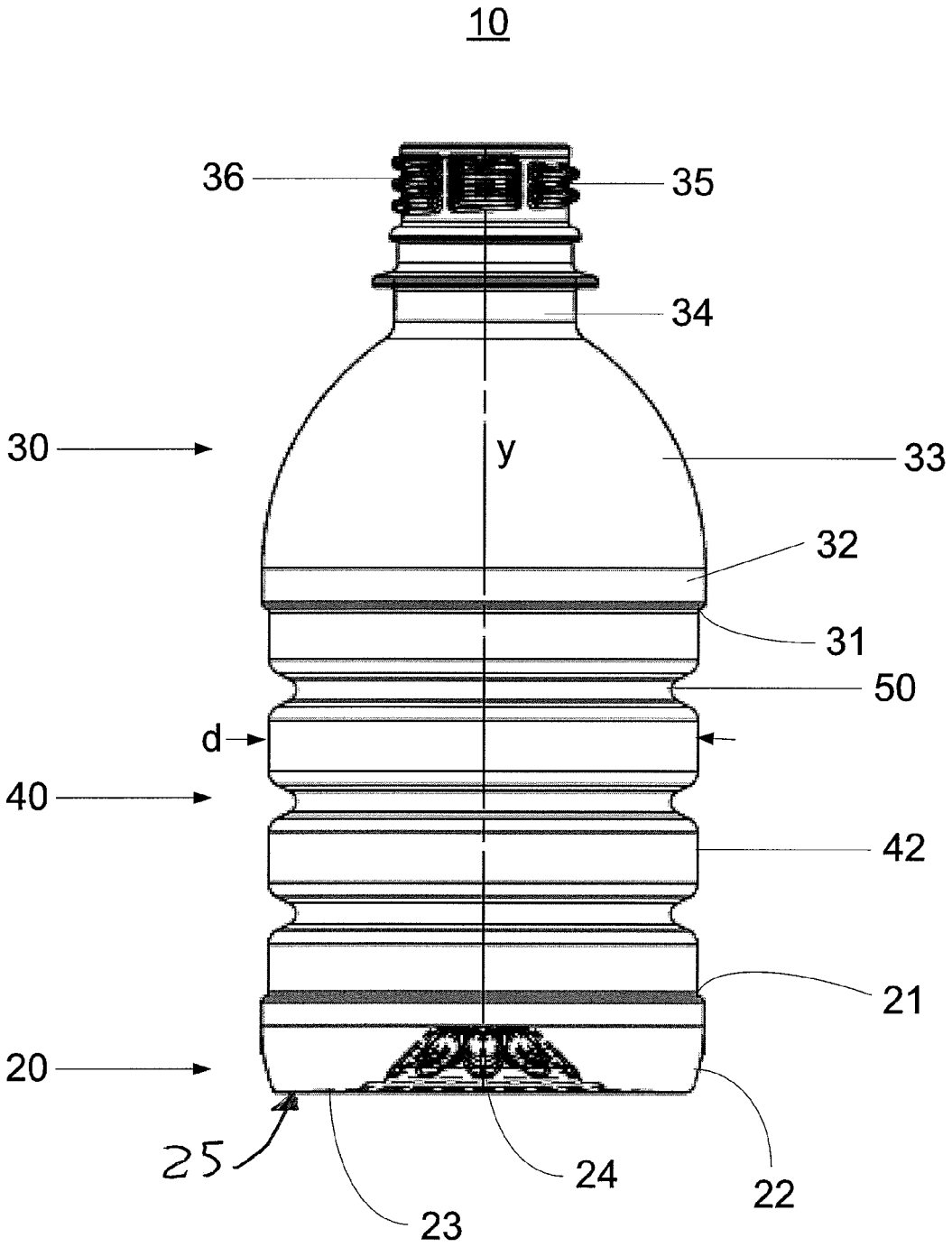
FIG. 1 is a side elevation view of a hot-fill container constructed in accordance with one embodiment including a plurality of vacuum compensation ribs.

Referring to FIG. 1, a container 10 extends along a vertical axis y and includes a lower portion 20, an upper portion 30, and a body portion 40 extending between the lower portion 20 and the upper portion 30. The body portion 40 is cylindrical in the illustrated embodiment, and includes one or more side walls 42 along with one or more vacuum compensation ribs 50.

The container 10 is oriented in FIG. 1 as extending vertically, or axially, along the vertical axis y, and radially, or horizontally, along a horizontal direction that is perpendicular with respect to the vertical axis y, it being appreciated that the actual orientations of the container 10 may vary during use. Thus, the directional term "vertical" and its derivatives are used with reference to a direction along axis y (or axial direction), and the directional term "horizontal" and its derivatives are used with reference to a direction perpendicular to axis y (or radial direction), it being appreciated that these directional terms and derivatives thereof are used to describe the container 10 and its components with respect to the orientation illustrated in FIG. 1 merely for the purposes of clarity and illustration.

The lower portion 20 includes an enclosed base 25 that extends vertically down from the body portion 40. As shown in FIG. 1, lower portion 20 preferably includes a lower label bumper 21, a circumferential heel 22, a circular standing ring 23, and a reentrant portion 24. The lower label bumper 21 is located at the boundary between the lower portion 20 and the body portion 40, and extends vertically down from the sidewall 42 of the body portion 40 to the heel 22. The heel 22 extends vertically down to the standing ring 23.

The reentrant portion 24, which is shown in dashed lines in FIG. 1, extends vertically up from the standing ring 23 on the underside of the container. Reentrant portion 24 may be of any type. For example, reentrant portion 24 may include conventional, radial reinforcing ribs, may be rigid or configured to deform in response to internal vacuum and function with the vacuum compensation features of container 10, or may comprise other structure.

As shown in FIG. 1, the upper portion 30 extends vertically up from the body portion 40 and preferably includes an upper label bumper 31, a cylindrical portion 32, a dome 33, a neck 34, and a finish 35 that has threads 36. The upper label bumper 31 is located at the boundary between the upper portion 30 and the body portion 40, and extends upward from the sidewall 42 of the body portion 40 to the cylindrical portion 32. The cylindrical portion 32 preferably is short relative to the vertical length of dome 33. The cylindrical portion 32 extends vertically up from the upper label bumper 31 to the dome 33. The dome 33 extends vertically up and radially in to a neck 34. The neck 34 extends vertically up to a finish 35 that has threads 36 configured to receive corresponding threads of a closure member to close an interior that is defined by the container 10, for instance the lower portion 20, the upper portion 30, and the body portion 40. As shown in FIG. 1, the body portion 40 extends substantially between the lower and upper label bumpers 21 and 31, respectively, and preferably is cylindrical to enable a label to be applied around its circumference.

The container 10 can be a pressure-responsive that is configured to absorb internal pressure that accumulates, for instance during a hot-fill process or due to the egress of moisture over time. In this regard, it should be appreciated that the container 10 can be a hot-fill or a cold-fill container. The container 10 can be formed from any suitable material, such as polyethylene terephthalate (PET), polybutylene terephthalate (PBT), polyethylene naphthalate (PEN), or a blend comprising the same. Typically, container 10 is formed by a stretch blow molding operation, but the present invention is not intended to be limited by the method of forming the container.

The body portion 40 illustrated in FIG. 1 includes a plurality (i.e., two or more) ribs 50 configured provide vacuum compensation under vacuum conditions inside the container 10. FIG. 1 shows the container 10 as including three vacuum compensation ribs 50. As will become apparent from the description below, each rib 50 can be configured to flex vertically, thereby providing for vertical, or non-radial, vacuum compensation. The vertical vacuum compensation allows the container 10 to maintain its substantially cylindrical shape while being devoid of vacuum panels.

Figure 5A:
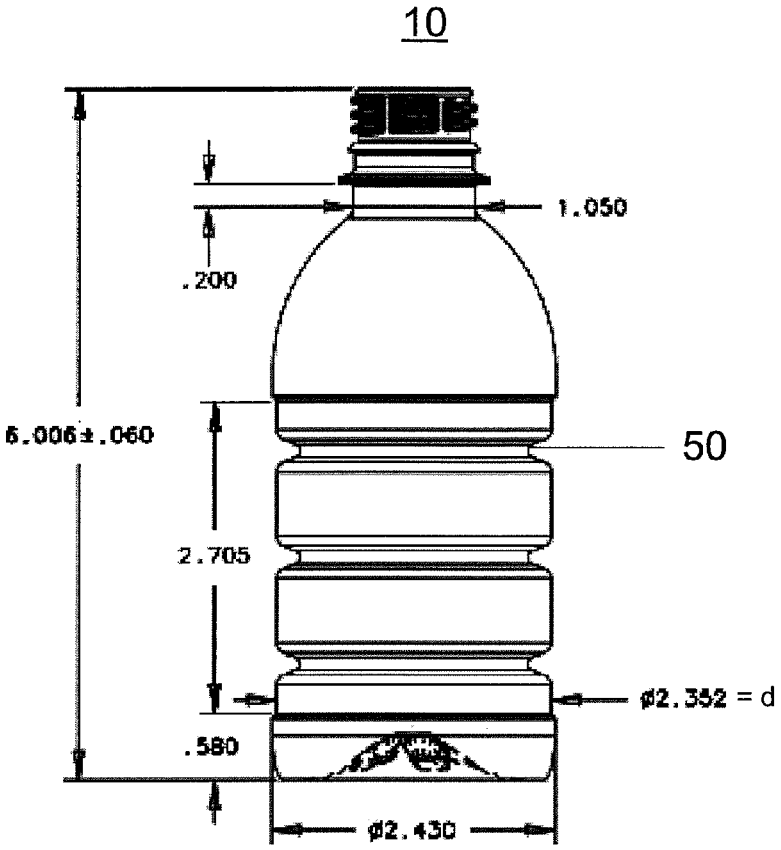
FIG. 5A is a side elevation view of the hot-fill container illustrated in FIG. 1 sized as a 10 oz. plastic container.

The body portion 40 may further comprise sidewalls 42 disposed adjacent to the ribs 50 along the vertical axis y of the container 10. Thus, a sidewall 42 may be disposed above another sidewall 42 and below a rib 50. Alternatively, the body portion 40 may include ribs 50 that are immediately adjacent one or both of the bumpers 31 and 21, such that the sidewalls 42 are disposed only between adjacent ribs 50. The sidewalls 42 are preferably substantially cylindrical and extend substantially vertically. Further, the sidewalls 42 define a diameter d of the body portion 40 of the container 10, as shown in FIGS. 1 and 5A.

Figure 6:
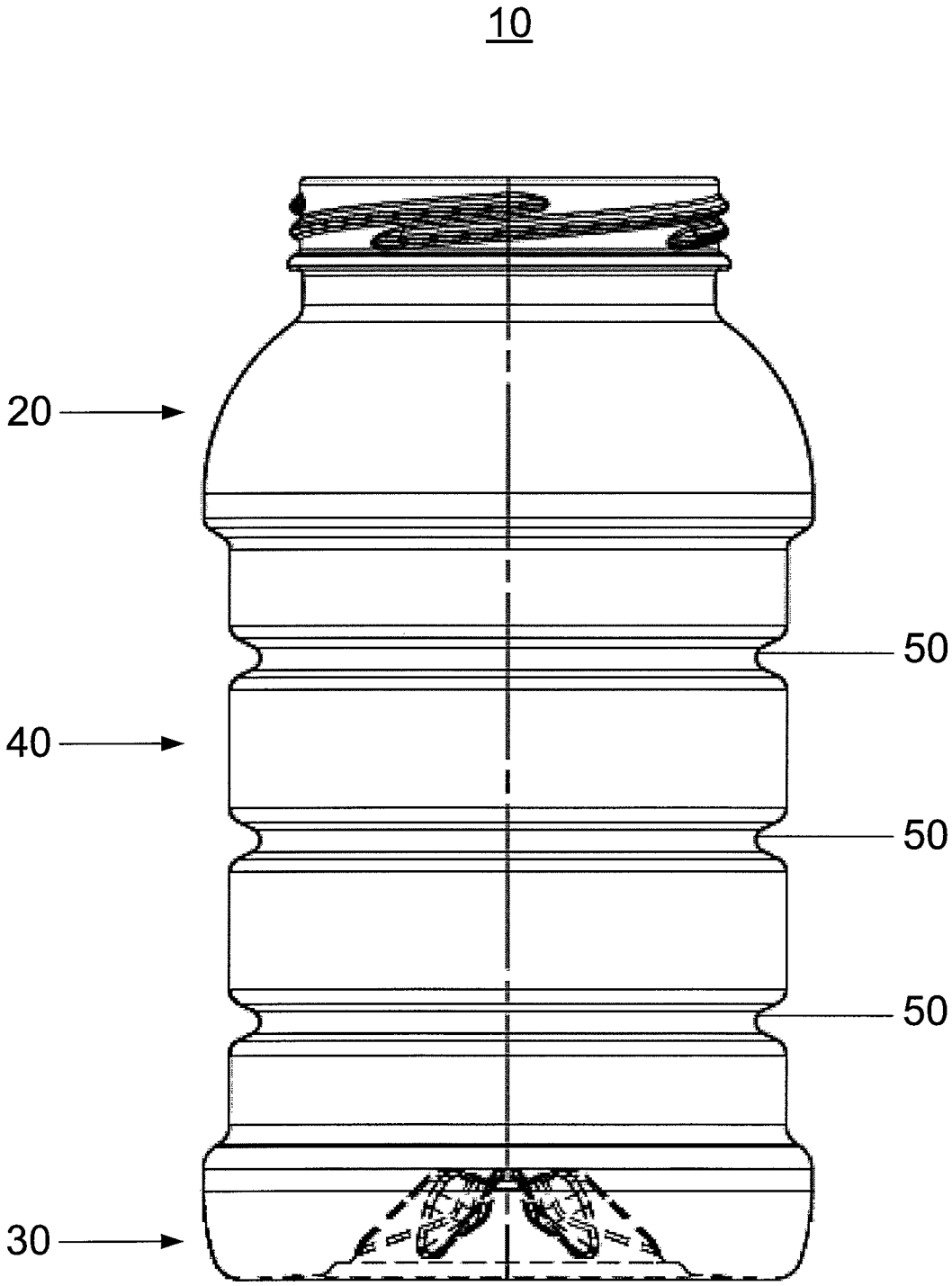
FIG. 6 is a side elevation view of the hot-fill container illustrated in FIG. 1, but constructed in accordance with an alternative embodiment.
Figure 7:
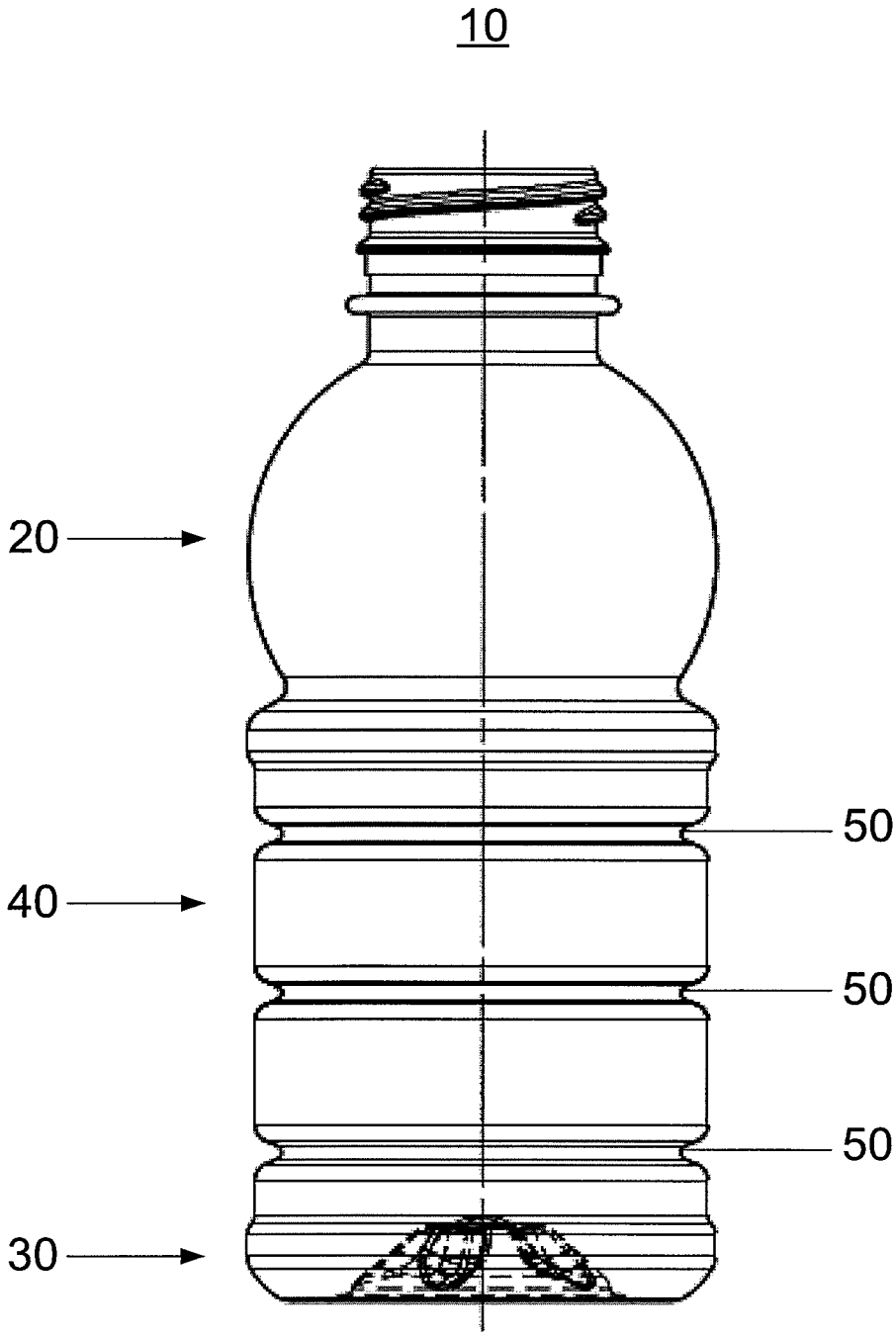
FIG. 7 is a side elevation view of the hot-fill container illustrated in FIG. 1, but constructed in accordance with another alternative embodiment.

It should be appreciated that the container illustrated in FIG. 1 is just one embodiment of a container, and that any suitable container can be used in connection with the present invention. For instance, FIG. 6 illustrates the container 10 has including a large-mouth opening, and containers that are configured as shown in FIG. 7 and have a semi-spherical dome. Further variations of the container 10 are contemplated so long as they are configured to compensate for negative internal pressure in the manner described below.

Figure 2A:
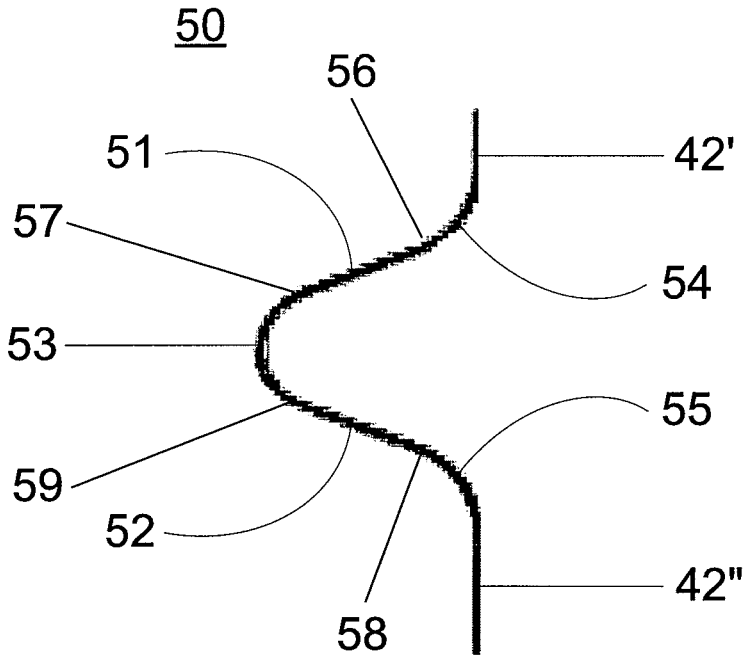
FIG. 2A is an enlarged side elevation view of one of the vacuum compensation ribs illustrated in FIG. 1.
Figure 2B:
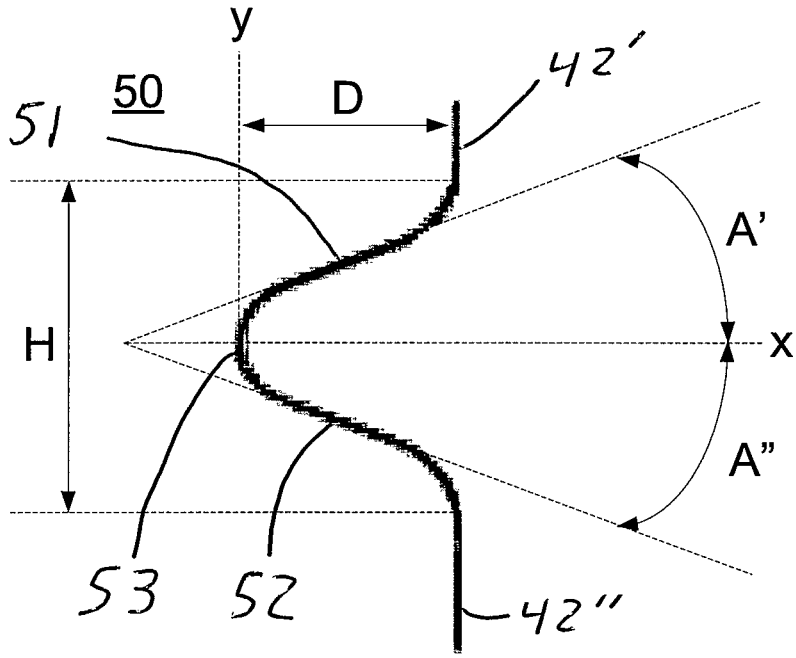
FIG. 2B is another enlarged side elevation view of the vacuum compensation rib illustrated in FIG. 1 showing dimensional information.

Referring now also to FIGS. 2A-B, each rib 50 is illustrated as being circumferentially continuous and extending in a substantially horizontally inward, or non-vertical, direction from the body portion 40. Each rib 50 is adapted to provide vacuum compensation when negative internal pressure accumulates within the container 10. Each rib 50, when viewed in transverse cross-section (that is, viewed after a vertical plane coincident with the vertical axis y has bisected the container 10), includes an upper wall 51, a lower wall 52, and a curved central portion 53 connected between the upper and lower walls. The upper wall 51 is connected to a first sidewall 42' and lower wall 52 is connected to a second sidewall 42", the sidewalls defining substantially cylindrical portions of the container 10.

As illustrated, the upper wall 51 and lower wall 52 extend in a substantially straight direction. However, either one or both of the upper wall 51 and the lower 52, may be curved as desired. The curved central portion 53 comprises a single radius of curvature, but may alternatively comprise a compound radius of curvature. Although the upper wall 51 and lower wall 52 are shown connected by a curved central portion 53, they may be connected directly or by other intervening structures. For instance, according to an alternative embodiment, the rib 50 does not include a curved central portion and the upper wall 51 is directly connected to the lower wall 52.

Additionally, the upper wall 51 may be connected to the first sidewall 42' by a curved upper transition 54, and the lower wall 52 may be connected to the second sidewall 42" by a curved lower transition 55. Each of the curved upper transition 54 and curved lower transition 55 preferably comprises a single radius of curvature, but may alternatively comprise a compound radius of curvature. It should further be appreciated that the upper wall 51 can be directly connected the first sidewall 42' without a curved upper transition 54, and the lower wall cab be directly connected to the second sidewall 42" without a curved lower transition 55.

The upper wall 51 is connected to the curved upper transition 54, or to the first sidewall 42' if there is no curved upper transition 54, at a first upper junction 56. The upper wall 51 is connected to the curved central portion 53, or to the lower wall 52 if there is no curved central portion 53, at a second upper junction 57. The lower wall 52 is connected to the curved lower transition 55, or to the second sidewall 42" if there is not curved lower transition 42", at a first lower junction 58. The lower wall 52 is connected to the curved central portion 53, or the upper wall 51 if there is no curved central portion 53, at a second lower junction 59. The junctions associated with the upper and lower walls may define a geometric shape different than that of the surrounding structure. For instance, the junctions may define a radius of curvature that is less than one of the surrounding structures, and greater than the other surrounding structure. As one example, the junction 56 defines a radius of curvature that is greater than that of the curved upper transition 54, and less than that of the upper wall 51 (whose radius of curvature may be infinite when the upper wall 51 is substantially flat as illustrated).

As illustrated in FIG. 2B, each rib 50 defines a rib height H and a rib depth D. The rib height H is defined as the vertical distance between an upper portion of a rib 50 that is connected to a first sidewall 42' (such as the upper end of the upper wall 51 or the upper end of the curved upper transition 54), and a lower portion of a rib 50 that is connected to a second sidewall 42" (such as the lower end of the lower wall 52 or the lower end of the curved lower transition 55. The rib depth D is defined as the radial distance between a sidewall 42 and a radially innermost portion of a rib 50.

Further, as shown in FIG. 2B, each of the upper wall 51 and the lower wall 52 is inclined with respect to the horizontal direction as indicated by a horizontal reference line x. In particular, each of the upper wall 51 and the lower wall 52 defines an angle A' and A", respectively, with respect to the reference line x. In one embodiment where the upper wall 51 and lower wall 52 are straight, angle A' may be defined simply as the angle by which the upper wall 51 is inclined from a horizontal reference line x, and angle A" may be defined as the angle by which the lower wall 52 is inclined from a horizontal reference line x. In another embodiment where the upper wall 51 and lower wall 52 are curved, angle A' may be defined as the angle between a line extending through the first upper junction 56 and the second upper junction 57, and a horizontal reference line x. The angle A" may be defined as the angle between a line extending through a first lower junction 58 and a second lower junction 59, and a horizontal reference line x. Angle A' and A" are preferably the same as illustrated, but may be different.

According to one aspect of the invention, the one or more ribs 50 of the container 10 are adapted to provide vertical vacuum compensation during a hot-fill process. In particular, a rib 50 is adapted to provide vacuum compensation by diminishing in height H. A rib 50 is configured to diminish in height H by allowing an upper wall 51 and lower wall 52 to flex and/or hinge toward each other in response to vacuum conditions inside the container 10. Thus, in accordance with a preferred embodiment, the curved central portion 53 acts as a hinge that allows an upper wall 51 and lower wall 52 to flex and/or hinge toward each other. Alternatively, the radially inner ends of the upper and lower walls 51 and 52 are directly connected and hinge about the joint between the walls 51 and 52.

Figure 3:
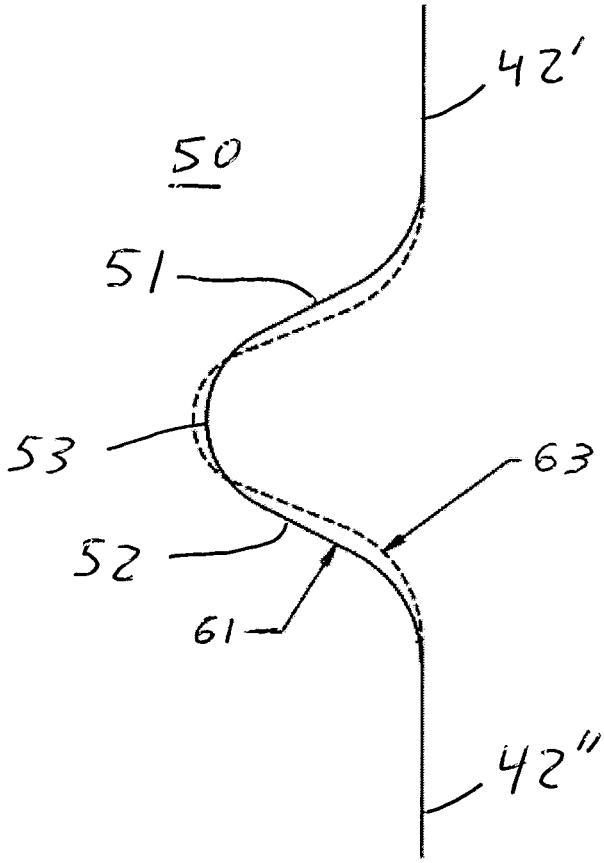
FIG. 3 is an enlarged side elevation view of one of the vacuum compensation ribs illustrated in FIG. 1, showing the rib in both a deformed state and in an undeformed, or as-molded, state.

As shown in FIG. 3, the rib 50 flexes in response to the accumulation of negative internal pressure from an undeformed, or as molded, state 61 to a deformed state 63. As illustrated, the upper wall 51 and lower wall 52 hinge or flex toward each other and the height of the rib 50 decreases in response to the accumulation of negative pressure inside the container 10. The sidewalls 42 are therefore pulled vertically closer together and the overall height of the container 10 is reduced. The curved central portion becomes radially inwardly displaced in response to the accumulation of negative internal pressure, thereby increasing the depth D as the height H decreases. As the overall height of the container 10 is reduced, the volume of the container 10 is reduced, thereby decreasing the internal volume of the container 10 and absorbing the negative internal pressure.

The geometry of the rib 50 offers performance advantages over ribs having an upper wall and lower wall connected by a straight (e.g., vertical) central wall rather than a curved central portion 53. For example, the curved central portion 53 allows for more efficient vertical compensation. That is to say, for a given rib height H, a rib including the curved central portion 53 provides more vertical vacuum compensation than a rib having a straight central wall. This is true because a straight central wall is not adapted to diminish in height in response to internal vacuum forces, whereas the curved central portion 53 is. Thus, the rib design employing the curved central portion 53 provides greater vertical vacuum compensation than a rib employing a straight central portion.

The container 10 is adapted to provide vertical vacuum compensation during a hot-fill process. In a hot-filling process, a product (for instance a liquid product) may be introduced into the interior of the container 10 at fill temperature, which can be elevated with respect to the ambient, or room temperature, for instance 180 to 190 degrees F., and the container 10 can be capped to create a hermetic seal to the interior. The product in the container 10 is subsequently allowed to cool, for instance to cooled temperature that is less than the fill temperature, for instance substantially at the ambient temperature or to a temperature that is less than ambient temperature, or in some instances greater than the ambient temperature. Cooling of the product causes the product to contract and creates a vacuum condition inside the container (i.e. negative internal pressure relative to ambient pressure). Once the product is cooled, a label can be applied to the outer surface of the container 10 between the upper and lower bumpers 31 and 21, respectively, in the manner described above. Because the container 10 maintains its substantially cylindrical shape after the product is cooled, the label has an enhanced aesthetic appeal compared to conventional containers having vacuum compensation panels that flex radially inward upon cooling of the product. Thus, the container 10 including one or more vacuum compensation ribs 50 provides a method of manufacturing a container that can include the steps of hot-filling a bottle and causing the ribs 50 to provide vertical displacement in the manner described herein.

The container 10 is further adapted to provide vertical vacuum compensation throughout the shelf life of the container, for instance as moisture escapes through the lower portion 20, upper portion 30, and/or body portion 40. The ribs 50 of the container 10 are allowed to diminish in height in response to the negative internal pressure in the container 10, thereby providing vertical vacuum compensation.

Figure 4:
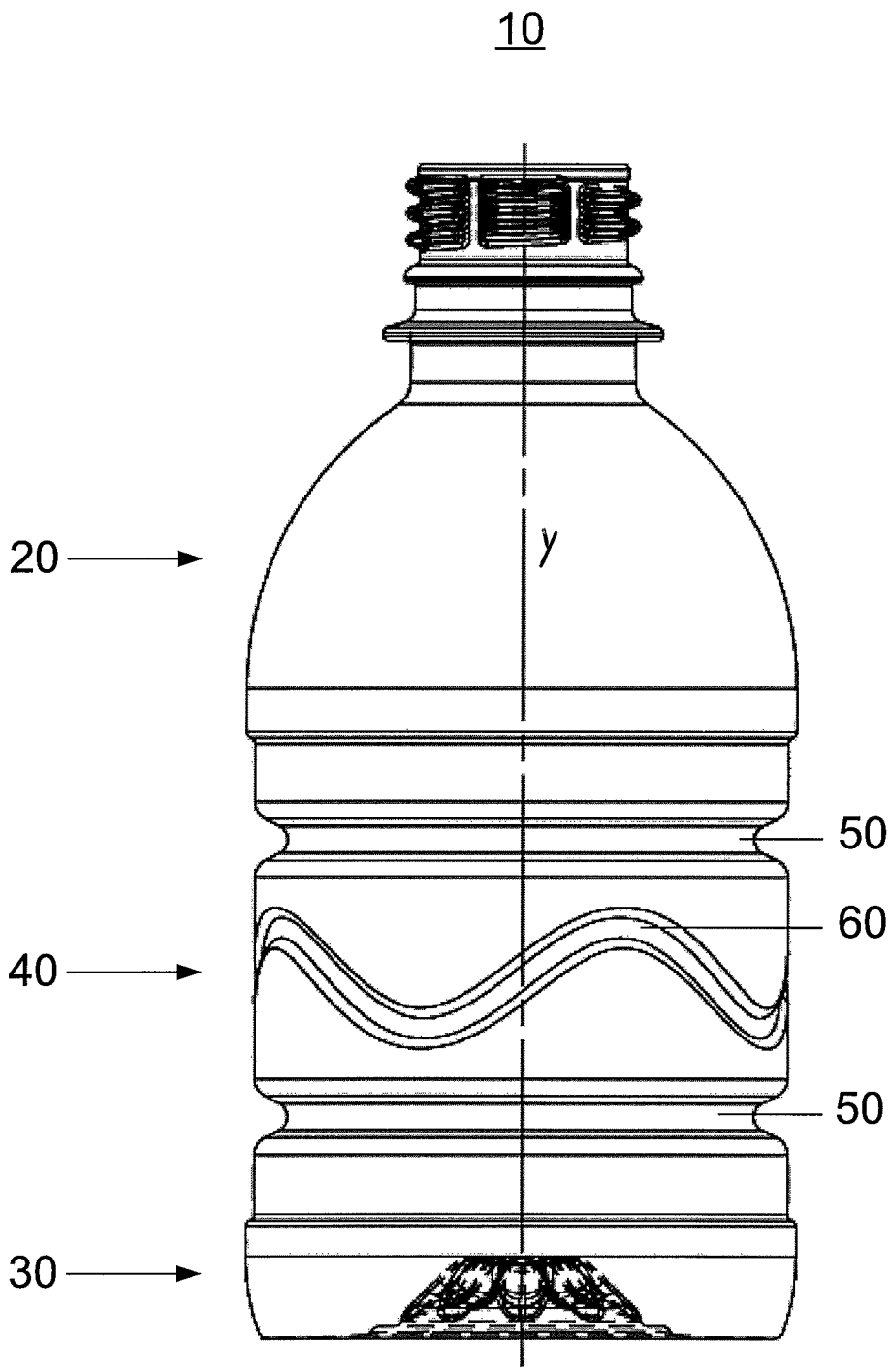
FIG. 4 is a side elevation view of a hot-fill container as illustrated in FIG. 1, but including a stiffening rib constructed in accordance with one embodiment.

Referring now to FIG. 4, the sidewalls 42 may comprise stiffening and/or ornamental features, such as, for example, one or more continuous or non-continuous horizontal ribs, vertical ribs, wave-like ribs, alphanumeric indicia, and decorative patterns. Such features may serve to stiffen the sidewalls 42 extending above and below the vacuum compensation ribs 50 such that a given rib 50 may be spaced further apart from an adjacent rib 50, lower bumper 21, or upper label bumper 31 without decreasing the resistance of the sidewall 42 to failure under vacuum conditions inside the container 10. For example, FIG. 4 illustrates a stiffening feature in the form of a continuous, wave-like stiffening rib 60 carried by one or more, up to all, of the sidewalls 42. The stiffening rib 60 can either extend radially in from the sidewall 42 or radially out from the sidewall 42, and stiffens the sidewall 42 and allows the areas of the container 10 that provide vertical compensation (for instance the ribs 50) to be spaced further apart vertically. It should thus be appreciated that the stiffening ribs 60 provide a lager landing area for adhering labels. Because the landing area does not deform either radially or vertically under vacuum conditions inside the container 10, the appearance of the label (not shown) is not affected by the vacuum compensation of the ribs 50.

According to another aspect of the invention, ribs 50 may also enhance the hoop strength and substantially cylindrical shape, of the body portion 40 of the container 10 while being devoid of vacuum panels. Additionally, as mentioned above, the sidewalls 42 may comprise stiffening and/or ornamental features, such as, for example, non-continuous horizontal ribs, vertical ribs, wave-like ribs, alphanumeric indicia, and decorative patterns. Such features may serve to stiffen the sidewalls 42 extending above and below the ribs 50 such that a rib 50 may be spaced further apart from an adjacent rib 50, lower bumper 21, or upper label bumper 31 without decreasing the sidewalls' 42 resistance to failure under vacuum conditions inside the container 10.

Aspects of the present invention recognize that certain aspects of a rib 50 described above may be controlled to increase the vertical vacuum compensation of the rib 50. In particular, the inventor has found that the rib depth D, and the angles A' and A" of the lower 51 and upper 52 walls relative to the horizontal may be controlled to produce a desired vertical vacuum compensation of a rib 50. Although a rib 50 may have a depth D in a wide range, the inventor has found that a rib depth D that is less than 20% of the diameter d of the body portion 40 of the container 10 is preferable for providing vertical vacuum compensation. Additionally, although a rib 50 may comprise an upper wall 51 and lower 52 inclined from a horizontal reference line in a wide range of angles A' and A", respectively, the inventor has found that angles A' and A" less than 35° are preferable for providing vertical vacuum compensation. The radius of curvature R (see FIG. 5A) of a curved central portion 53 may be optimized in combination with the rib depth D, and the angles A' and A" to provide vertical vacuum compensation.

Figure 5B:
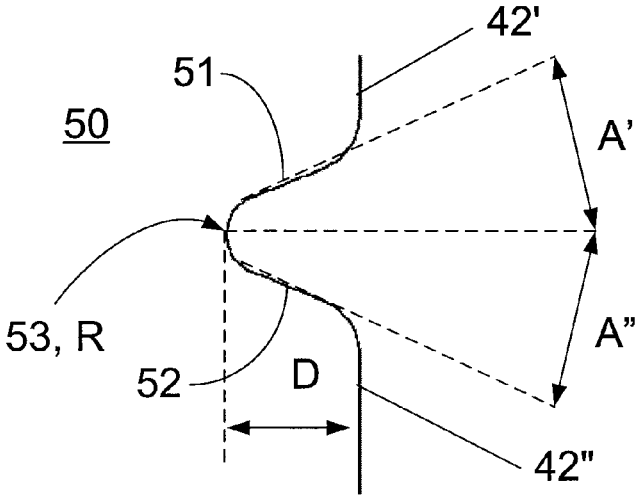
FIG. 5B is an enlarged side elevation view of the vacuum compensation rib illustrated in FIG. 5A.

The desired dimensions of the rib 50 for providing vertical vacuum compensation may vary depending upon the size of the container 10 and relative magnitude of the dimensions of the container 10 (e.g. height, diameter). For example, a linear optimization analysis was performed on a 10 oz. container configured as shown in FIG. 5A to find the most desirable dimensions of the ribs 50 configured as shown in FIG. 5B. As shown in FIGS. 5A-5B, the container 10 comprises three identical horizontal ribs 50 that are evenly spaced along a vertical axis of the body portion 40 of the container 10. The three ribs 50 constructed identically and each includes an upper wall 51, a lower wall 52, and a curved central portion 53. The upper wall 51 is inclined from a horizontal reference line x at an angle A' and the lower wall 52 is inclined from a horizontal reference line x at an angle A". Angle A' and A" are the same. Central portion 53 comprises a single radius of curvature R. The dimensions shown in FIG. 5A are in inches. The linear optimization analysis was directed to the dimensions of the radius of curvature R, depth D, and angles A' and A" in order to increase vertical vacuum compensation of the ribs 50.

Below are charts in FIGS. 8-12 illustrating the cumulative vertical displacement of the three ribs, as shown in the container 10 of FIGS. 5A-5B, when the container is subjected to a predetermined internal pressure under various geometric configurations of the ribs 50. The predetermined internal pressure was consistent for each of the charts below, thereby indicating the relationships between the performance of various geometric configurations of the ribs 50.

Figure 8:
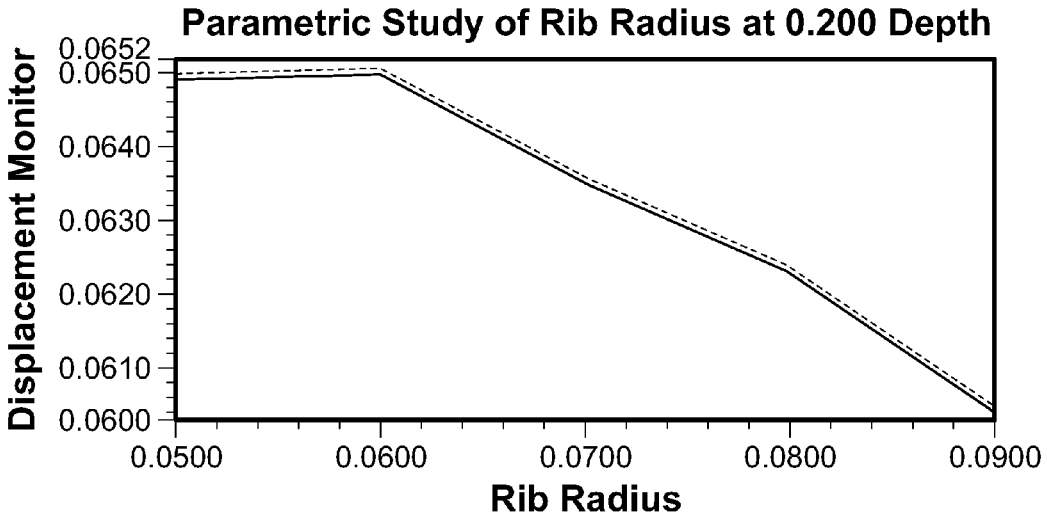
FIG. 8 is a chart showing the vertical displacement of three ribs relative to the radius of curvature of the ribs where the ribs are fixed at 0.200 inches and the radius of curvature R is increased from 0.0500 inches to 0.0900 inches.

In the chart shown in FIG. 8, the depth D of the ribs is fixed at 0.200 inches and the radius of curvature R is increased from 0.0500 inches to 0.0900 inches. The vertical axis of the chart shows the vertical displacement of the three ribs in inches, and the horizontal axis shows the radius of curvature R in inches. Vertical displacement refers to the amount that the ribs diminish in height in response to the applied negative internal pressure in the container 10 (i.e. vertical vacuum compensation). According to this embodiment, the vertical displacement capability of the three ribs increases as the radius of curvature R increases from 0.0500 inches to 0.0600 inches, and decreases as the radius of curvature R increases from 0.0600 inches to 0.0900 inches. Further, as shown, the ribs 50 are configured to achieve the greatest amount of vertical displacement (0.0652 inches of vertical displacement) when the radius of curvature R is 0.0600 inches. It should be appreciated that all of the dimensional information described herein includes dimensions that are "about" the specified value. For instance, the radius of curvature R noted immediately above include a values that is about 0.0600 inches.

Figure 9:
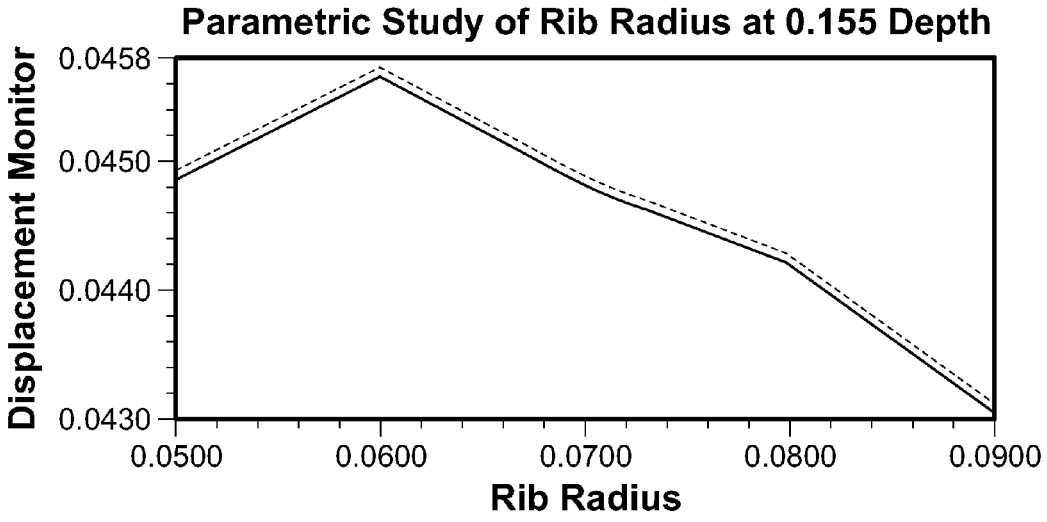
FIG. 9 is a chart showing the vertical displacement of three ribs relative to the radius of curvature of the ribs where the depth of the ribs is fixed at 0.155 inches and the radius of curvature R is increased from 0.0500 inches to 0.0900 inches.

FIG. 9 shows another chart illustrating the vertical displacement of the three ribs, as shown in the container 10 of FIGS. 5A-5B, where the depth D of the ribs is fixed at 0.155 inches and the radius of curvature R is increased from 0.0500 inches to 0.0900 inches. Again, the vertical axis of the chart shows the vertical displacement of the three ribs in inches in response to the predetermined internal pressure, and the horizontal axis shows the radius of curvature R in inches. According to this embodiment, the vertical displacement of the three ribs increases as the radius of curvature R increases from 0.0500 inches to 0.0600 inches generally decreases as the radius of curvature R increases from 0.0600 inches to 0.0900 inches. Further, as shown, the ribs 50 are configured to achieve the greatest amount of vertical displacement (about 0.0458 inches of vertical displacement) when the radius of curvature R is 0.0600.

Figure 10:
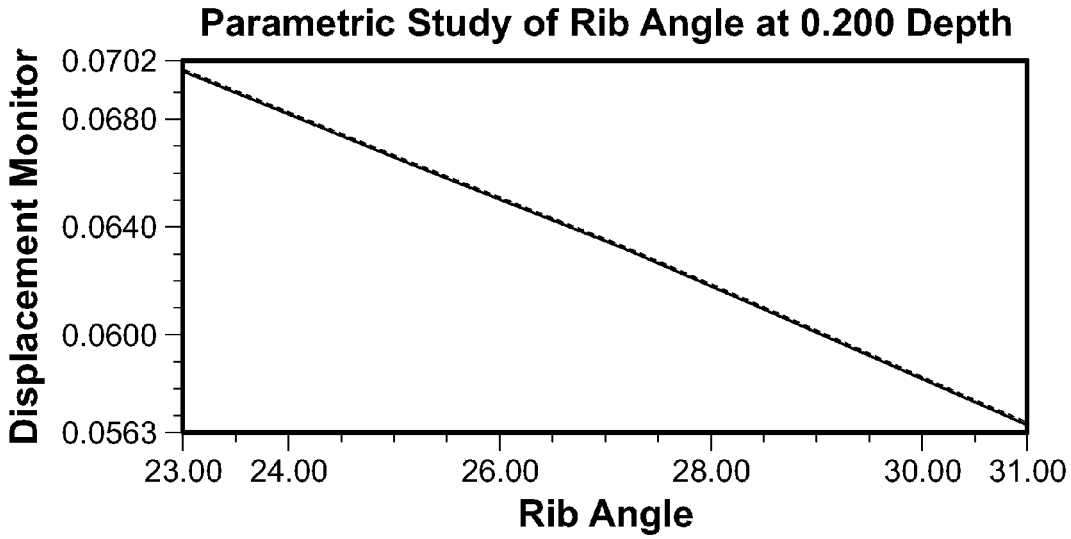
FIG. 10 is a chart showing the vertical displacement of three ribs relative to the radius of curvature of the ribs where the depth D of the ribs is fixed at 0.200 inches, and the angles A' and A" are increased from 23° to 31°.

FIG. 10 shows a chart illustrating the vertical displacement of the three ribs, as shown in the container 10 of FIGS. 5A-5B, where the depth D of the ribs is fixed at 0.200 inches, and the angles A' and A" are increased from 23° to 31°. The vertical axis of the chart shows the vertical displacement of the three ribs in inches, and the horizontal axis shows the angles A' and A". According to this embodiment, the vertical displacement of the three ribs decreases as the angles A' and A' increases from 23° to 31°.

Figure 11:
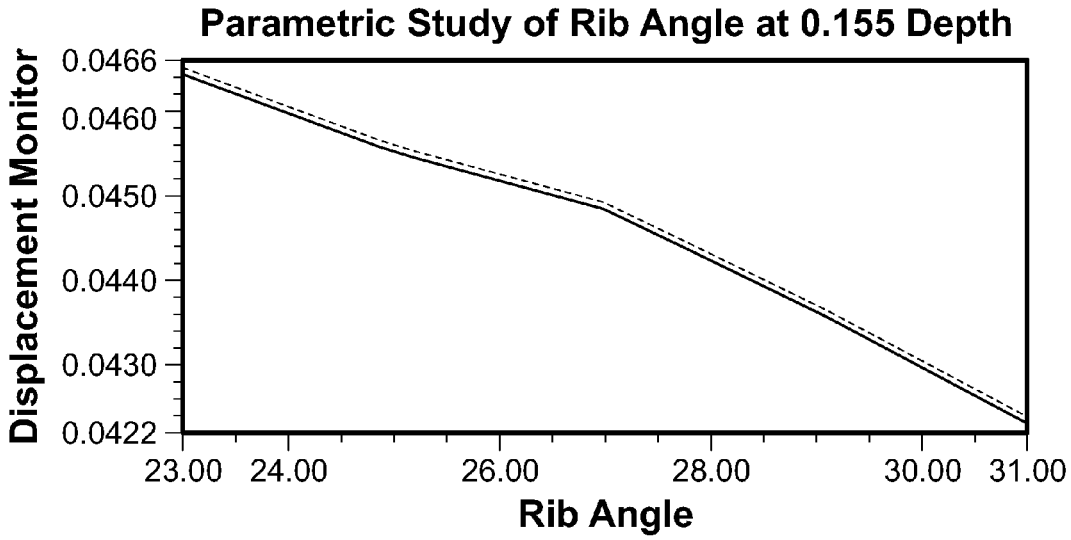
FIG. 11 is a chart showing the vertical displacement of three ribs relative to the radius of curvature of the ribs where the depth D of the ribs is fixed at 0.155 inches, and the angles A' and A" are increased from 23° to 31°.

FIG. 11 shows another chart illustrating the vertical displacement of the three ribs, as shown in the container 10 of FIG. 5A, where the depth D of the ribs is fixed at 0.155 inches, and the angles A' and A" are increased from 23° to 31°. Again, the vertical axis of the chart shows the vertical displacement of the three ribs in inches, and the horizontal axis shows the angles A' and A". According to this embodiment, the vertical displacement of the three ribs also decreases as the angles A' and A' increases from 23° to 31°.

Figure 12:
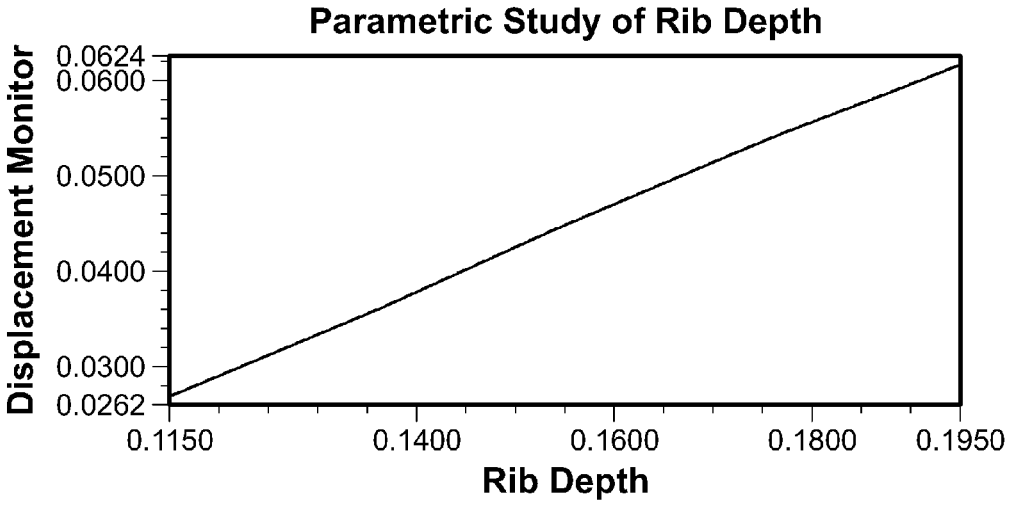
FIG. 12 is a chart showing the vertical displacement of three ribs relative to the radius of curvature of the ribs the vertical displacement of the three ribs increases as the depth of the ribs 50 increases from 0.1150 inches to 0.1950 inches

FIG. 12 shows a chart illustrating the relationship between vertical displacement of the three ribs 50 and the depth D of the ribs 50, as shown in the container 10 of FIG. 5A. The vertical axis of the chart shows the vertical displacement of the three ribs in inches, and the horizontal axis shows the depth D of the ribs 50. As shown, the vertical displacement of the three ribs increases as the depth of the ribs 50 increases from 0.1150 inches to 0.1950 inches.

Below is a table summarizing non-linear, finite-element analysis (FEA) predictions done on six container designs configured as shown in FIGS. 5A-5B, but each having slightly different rib dimensions. Each row in the table corresponds to a different container design identified as #1-#6 in the first column. The second column indicates the radius of curvature R of the central portion 53. The third column indicates the angles A' and A" at which the upper 51 and lower 52 walls are inclined. The fourth column indicates the depth D of the ribs 50. The fifth column indicates the maximum negative internal pressure that each container design can withstand before failing. The sixth column indicates the maximum change in volume (i.e. vacuum compensation) of each container design at the negative pressure level indicated in the corresponding row of column 5. Thus, for the general container configuration shown in FIGS. 5A-5B, the greatest negative internal pressure absorption is achieved using ribs 50 of design #6 having a radius of curvature R of 0.06 in., angles A' and A" of 22°, and a depth D of 0.200.

| Design | Radius R | Angles A' and A" | Depth D | Maximum Pressure | Maximun Δ Volume |
|---|---|---|---|---|---|
| #1 | 0.07 in. | 27° | 0.155 in. | −5.88 psi | −14.8 cc |
| #2 | 0.04 in. | 27° | 0.155 in. | −5.36 psi | −13.8 cc |
| #3 | 0.04 in. | 25° | 0.155 in. | −5.23 psi | −14.1 cc |
| #4 | 0.04 in. | 22° | 0.155 in. | −5.18 psi | −13.9 cc |

-continued

| Design | Radius R | Angles A' and A" | Depth D | Maximum Pressure | Maximun Δ Volume |
|---|---|---|---|---|---|
| #5 | 0.04 in. | 27° | 0.200 in. | −5.76 psi | −18.5 cc |
| #6 | 0.06 in. | 22° | 0.200 in. | −5.69 psi | −21.0 cc |

While apparatus and methods have been described and illustrated with reference to specific embodiments, those skilled in the art will recognize that modification and variations can be made without departing from the principles described above and set forth in the following claims. Accordingly, reference should be made to the following claims as describing the scope of the present invention.

What is claimed:

1. A pressure-responsive container comprising:

a lower portion including an enclosed base;

an upper portion including a dome and a finish; and a generally cylindrical body portion extending vertically along a longitudinal axis between the lower portion and the upper portion, the body portion including an upper sidewall and a lower sidewall, the body portion further comprising:

at least one circumferential rib disposed between the upper and lower sidewalls, the rib comprising:

a single, substantially straight upper wall, wherein an entire length of said upper wall defines a first angle less than 35 degrees with respect to a horizontal reference line that is transverse to the longitudinal axis;

a curved upper transition extending from said upper wall to said upper sidewall, said curved upper transition having a single radius of curvature between said upper wall and said upper sidewall;

a single, substantially straight lower wall, wherein an entire length of said lower wall defines a second angle less than 35 degrees from the horizontal reference line;

a curved lower transition extending from the lower wall to the lower sidewall, said curved lower transition having a single radius of curvature between said lower wall and said lower sidewall; and a curved central portion extending between the upper wall and the lower wall;

wherein the substantially straight upper wall and the substantially straight lower wall are adapted to hinge with respect to each other in response to a vacuum created inside the container such that a height of the container is reduced while the body portion retains a substantially cylindrical shape.

2. The container of claim 1 wherein the curved central portion has a single radius of curvature.

3. The container of claim 2 wherein the curved central portion has a radius of curvature of about 0.06 inches.

4. The container of claim 1 wherein the body portion does not include vacuum compensation elements that operate in a radial direction.

5. The container of claim 1 wherein the body portion consists of three circumferential, substantially horizontal ribs and two substantially cylindrical portions between the ribs.

6. The container of claim 5, further comprising a stiffening rib carried by one of the substantially cylindrical portions.

7. The container of claim 1 wherein each of the upper and lower walls defines an angle of 30 degrees or less with respect to the horizontal reference line.

8. The container of claim 1 wherein each of the upper and lower walls defines an angle of about 22 degrees with respect to the horizontal reference line.

9. A pressure-responsive and generally cylindrical container, comprising:

a lower portion, and upper portion, and a body portion extending vertically between the upper and lower portions, the body portion comprising:

at least one circumferential, substantially horizontal rib;

at least two substantially cylindrical sidewalls disposed above and below the at least one rib;

wherein the at least one rib comprises:

a single straight upper wall, a single straight lower wall, and a curved central portion extending between the upper and lower walls, such that the upper and lower walls are adapted to hinge with respect to each other in response to a vacuum created inside the container such that a height of the container is reduced while the body portion retains its generally cylindrical shape in the absence of vacuum panels;

a curved upper transition extending between the upper wall and one of the at least two sidewalls, said curved upper transition having a single radius of curvature between said upper wall and said one of the at least two sidewalls;

a curved lower transition extending between the lower wall and another of the at least two sidewalls, said curved lower transition having a radius of curvature between said lower wall and said one of the at least two sidewalls; and wherein a junction of the upper wall and the upper transition defines a first upper junction, a junction of the upper wall and the central portion defines a second upper junction, and a line extending through an entire length of the upper wall extending between the first upper junction and the second upper junction defines a single angle of 35 degrees or less with respect to a horizontal reference line.

10. The container of claim 9 wherein a junction of the lower wall and the lower transition defines a first lower junction, a junction of the lower wall and the central portion defines a first lower junction, and a line extending along an entire length of the lower wall between the first lower junction and the second lower junction defines an angle of 35 degrees or less with respect to the horizontal reference line.

11. The container of claim 9, wherein the central portion has a single radius of curvature.

12. The container of claim 11, wherein the central portion has a radius of curvature of about 0.06 inches.

13. The container of claim 10, wherein each one of the lines extending between the upper junction points and the lower junction points defines an angle of 30 degrees or less with respect to the horizontal reference line.

14. The container of claim 10, wherein each one of the lines extending between the upper junction points and the lower junction points defines an angle of 22 degrees or less with respect to the horizontal reference line.

15. The container of claim 9 wherein the upper portion defines a dome and a finish, the container further comprising an upper label bumper formed on a lower portion of the dome.

16. The container of claim 9 wherein the container is devoid of vacuum-panels.

17. A method of hot-filling a container that includes a lower portion, an upper portion, and a body portion extending between the lower portion and the upper portion, wherein the lower portion, the upper portion, and the body portion define an interior, and the body portion includes at least one vacuum compensation rib having:

(1) a single, substantially straight upper wall, wherein an entire length of the upper wall defines a first angle with a horizontal reference line, (2) a single, substantially straight lower wall, wherein an entire length of the lower wall defines a second angle with the horizontal reference line, (3) a curved upper transition extending between the upper wall and the upper portion, said curved upper transition having a single radius of curvature between said upper wall and said upper portion;

(4) a curved lower transition extending between the lower wall and the lower portion, said curved lower transition having a single radius of curvature between said lower wall and said lower portion; and (5) a curved central portion extending between the upper wall and the lower wall, the method comprising the steps of:

introducing a product into the interior of the container at a fill temperature that is increased with respect to an ambient temperature;

cooling the product to a cooled temperature that is less than the fill temperature, thereby causing internal pressure within the interior to accumulate; and causing the substantially straight upper wall and the substantially straight lower wall to hinge with respect to each other about the curved central portion, such that the at least one vacuum compensation rib deflects in a substantially vertical direction.

18. The method of claim 17, wherein the first angle is less than 35 degrees with respect to the horizontal reference line, and the second angle is less than 35 degrees from the horizontal reference line.

19. The method of claim 18, wherein the body has a generally cylindrical shape before the introducing step and during the causing step.

* * * * *